US008225510B2

(12) United States Patent
Peterson et al.

(10) Patent No.: US 8,225,510 B2
(45) Date of Patent: Jul. 24, 2012

(54) RAZORS AND RAZOR CARTRIDGES WITH A DECREASED TOTAL INTERBLADE SPAN

(75) Inventors: Mark Peterson, Reading (GB); Kevin David Cowley, Reading (GB); Oliver David Oglesby, Newbury (GB)

(73) Assignee: The Gillette Company, Boston, MA (US)

( * ) Notice: Subject to any disclaimer, the term of this patent is extended or adjusted under 35 U.S.C. 154(b) by 381 days.

(21) Appl. No.: 12/568,743

(22) Filed: Sep. 29, 2009

(65) Prior Publication Data

US 2010/0077617 A1 Apr. 1, 2010

Related U.S. Application Data

(60) Provisional application No. 61/101,038, filed on Sep. 29, 2008.

(51) Int. Cl.
*B26B 21/22* (2006.01)

(52) U.S. Cl. ..... 30/50; 30/41; 30/346.61

(58) Field of Classification Search ..... 30/34.05, 30/41, 50, 58, 77, 84, 537, 346.61
See application file for complete search history.

(56) References Cited

U.S. PATENT DOCUMENTS

| | | | | |
|---|---|---|---|---|
| 3,786,563 | A * | 1/1974 | Dorion et al. | 30/50 |
| 3,938,250 | A * | 2/1976 | Perry | 30/346.57 |
| 4,407,067 | A * | 10/1983 | Trotta | 30/50 |
| 4,640,012 | A * | 2/1987 | Thomas | 30/41 |
| 5,671,534 | A * | 9/1997 | Mayerovitch | 30/41 |
| 6,212,777 | B1 * | 4/2001 | Gilder et al. | 30/50 |
| 7,131,202 | B2 | 11/2006 | Pennell et al. | |
| 2001/0029669 | A1 * | 10/2001 | Ferraro et al. | 30/49 |
| 2002/0144404 | A1 | 10/2002 | Gilder et al. | |
| 2003/0204955 | A1 * | 11/2003 | Gilder et al. | 30/50 |
| 2003/0217469 | A1 | 11/2003 | Coffin | |
| 2005/0015991 | A1 | 1/2005 | Follo et al. | |
| 2005/0108882 | A1 | 5/2005 | Gilder et al. | |
| 2005/0198837 | A1 * | 9/2005 | Rawle | 30/346.57 |
| 2007/0124939 | A1 * | 6/2007 | Van Eibergen Santhagens | 30/50 |
| 2010/0077618 | A1 * | 4/2010 | Peterson | 30/50 |

* cited by examiner

*Primary Examiner* — Hwei C Payer
(74) *Attorney, Agent, or Firm* — Kevin C. Johnson; Steven W. Miller

(57) ABSTRACT

A wet shaving razor cartridge that comprises a plurality of at least five elongate blade assemblies disposed in parallel between a guard and a cap of a housing, each blade assembly having a sharp cutting edge; wherein said blade assemblies exhibit a cumulative interblade span of no greater than about 3 mm. Also, a wet shaving razor cartridge that comprise a plurality of at least four elongate blade assemblies disposed in parallel between a guard and a cap of a housing, each blade assembly having a sharp cutting edge; wherein said blade assemblies exhibit a cumulative interblade span of no greater than about 2.5 mm.

15 Claims, 2 Drawing Sheets

RAZORS AND RAZOR CARTRIDGES WITH A DECREASED TOTAL INTERBLADE SPAN

CROSS REFERENCE TO RELATED APPLICATIONS

This application claims the benefit of U.S. Provisional Application No. 61/101,038 filed Sep. 29, 2008.

FIELD OF THE INVENTION

This invention relates to wet shaving razor cartridges and razors including such cartridges where such cartridges exhibit a decreased total interblade span.

BACKGROUND OF THE INVENTION

Wet shaving razors have evolved over the years to include a multiplicity of blades with the goal of increasing the closeness of the shave that is achieved while also still providing a comfortable shaving experience. In particular, the blade assemblies include sharp cutting edges that engage the hair during cutting so as to extend the hair from the skin. After the hair is extended, it does not immediately retract into the skin. A second blade may further cut the hair before it fully retracts, so-called "hysteresis cutting," resulting in a closer shave. Wet shaving razors with multiple blades may provide multiple cutting and extending events and multiple opportunities for hysteresis cutting.

The distance between consecutive cutting edges or so-called "span" is theorized to affect the shaving process in several ways. The span between cutting edges may control the degree to which skin will bulge between blades, with smaller spans resulting in less skin bulge and more skin comfort during shaving, but may also increase opportunities for double engagement. Larger spans may reduce opportunities for double engagements but may result in more skin bulge between cutting edges and less skin comfort. Span between cutting edges and, thus between blades, may affect rinsing of shave preparations and shave debris after a shaving stroke, with larger spans easing or quickening rinsing and smaller spans slowing or making rinsing more difficult.

A need therefore exists to provide wet shaving razor cartridges having an increased number of blades within a cartridge that is acceptable to a shaver in terms of size, effectiveness, and rinsability.

SUMMARY OF THE INVENTION

This invention relates to wet shaving razor cartridges that comprise:

a plurality of at least five elongate blade assemblies disposed in parallel between a guard and a cap of a housing, each blade assembly having a sharp cutting edge;

wherein said blade assemblies exhibit a cumulative interblade span of no greater than about 3.4 mm.

This invention further relates to wet shaving razor cartridges that comprise:

a plurality of at least four elongate blade assemblies disposed in parallel between a guard and a cap of a housing, each blade assembly having a sharp cutting edge;

wherein said blade assemblies exhibit a cumulative interblade span of no greater than about 2.55 mm.

DETAILED DESCRIPTION OF THE INVENTION

In particular embodiments, this invention relates to wet shaving razor cartridges and razors including such cartridges wherein the cartridge comprises a plurality of at least five elongate blade assemblies disposed in parallel between a guard and a cap, both of a housing, each blade assembly having a sharp cutting edge and wherein the blade assemblies exhibit a cumulative interblade span of no greater than about 3.4 mm. In other embodiments, the present invention relates to wet shaving razor cartridges and razors including such cartridges wherein the cartridge comprises a plurality of at least four elongate blade assemblies disposed in parallel between a guard and a cap, both of a housing, each blade assembly having a sharp cutting edge and wherein the blade assemblies exhibit a cumulative interblade span of no greater than about 2.55 mm.

In a razor cartridge of the present invention which has a multiplicity of blade assemblies, the blade span of each blade assembly after the forwardmost or primary blade assembly will in general be the distance from the cutting edge of that blade assembly to the cutting edge of the blade assembly immediately in front of that blade assembly. Thus, for these subsequent blade assemblies it is convenient to refer to the "interblade span" or "$S_{IB}$". As used herein, the "cumulative interblade span" or "$S_{CIB}$" shall refer to the entirety of the interblade spans from the forwardmost blade assembly edge (i.e., closest to the guard) to the rearwardmost blade assembly edge (i.e., closet to the cap) as shown in FIG. 1.

Figure 1:
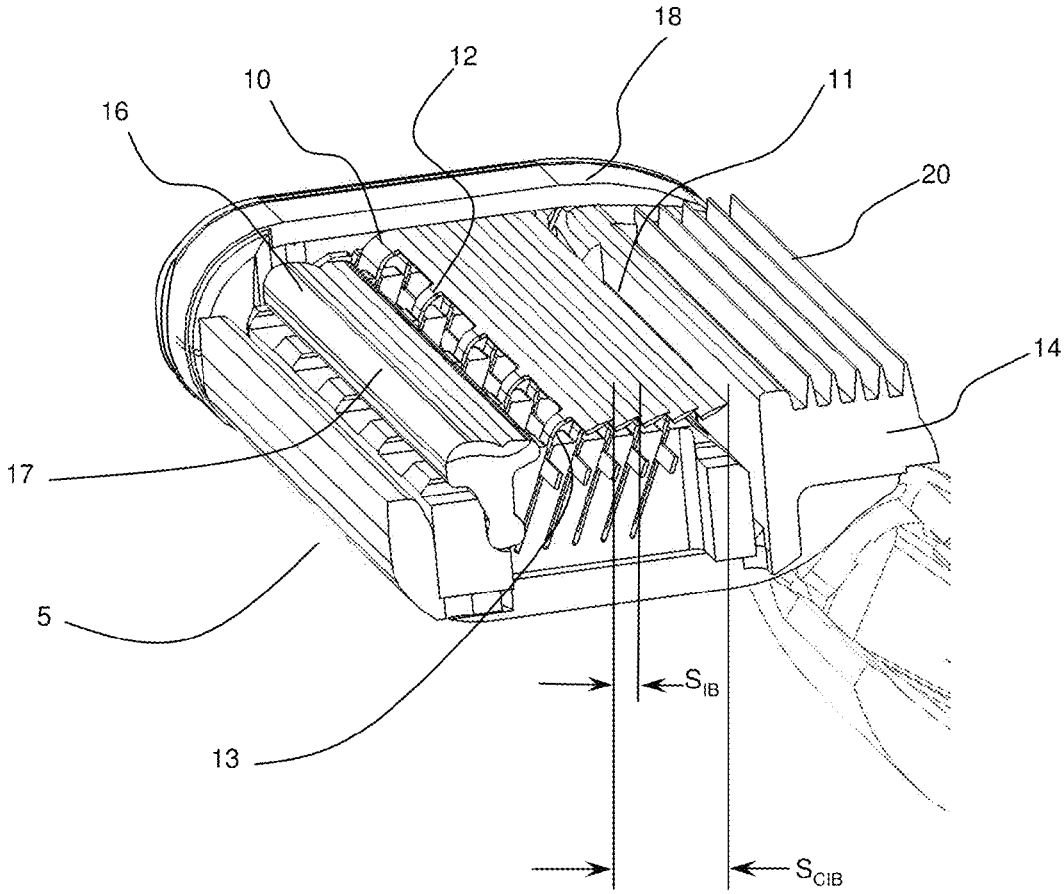
FIG. 1 is a perspective of a razor cartridge of the present invention.

In FIG. 1, a razor cartridge 5 of the present invention is shown. The cartridge comprises a housing 18 and at least 5 elongate blade assemblies 10 having sharp cutting edges 11. The blade assemblies 10 are disposed between a guard 14 and a cap 17. The guard 14 of this embodiment further comprises an optional plurality of elastomeric fins 20. Such fins may take the form of substantially parallel elongations that run a length of the guard. Alternatively, the fins may comprise a plurality of curved projections, e.g., circular tubes, semicircular projections, chevron shaped projections, etc. and even combinations thereof. The cap 17 may comprise a lubricating strip 16. Such a lubricating strip may comprise skin conditioning agents that improve the appearance and sensation encountered by the shaver upon completion of the shaving stroke. The lubricating strip may comprise a shaving enhancement product, such as a lubricant which gradually leaches out of the strip material during shaving. Moreover, the positions of the projections and lubricating strip may be alternated so that the fins are on the cap and the lubricating strip is disposed on the guard.

Figure 2:
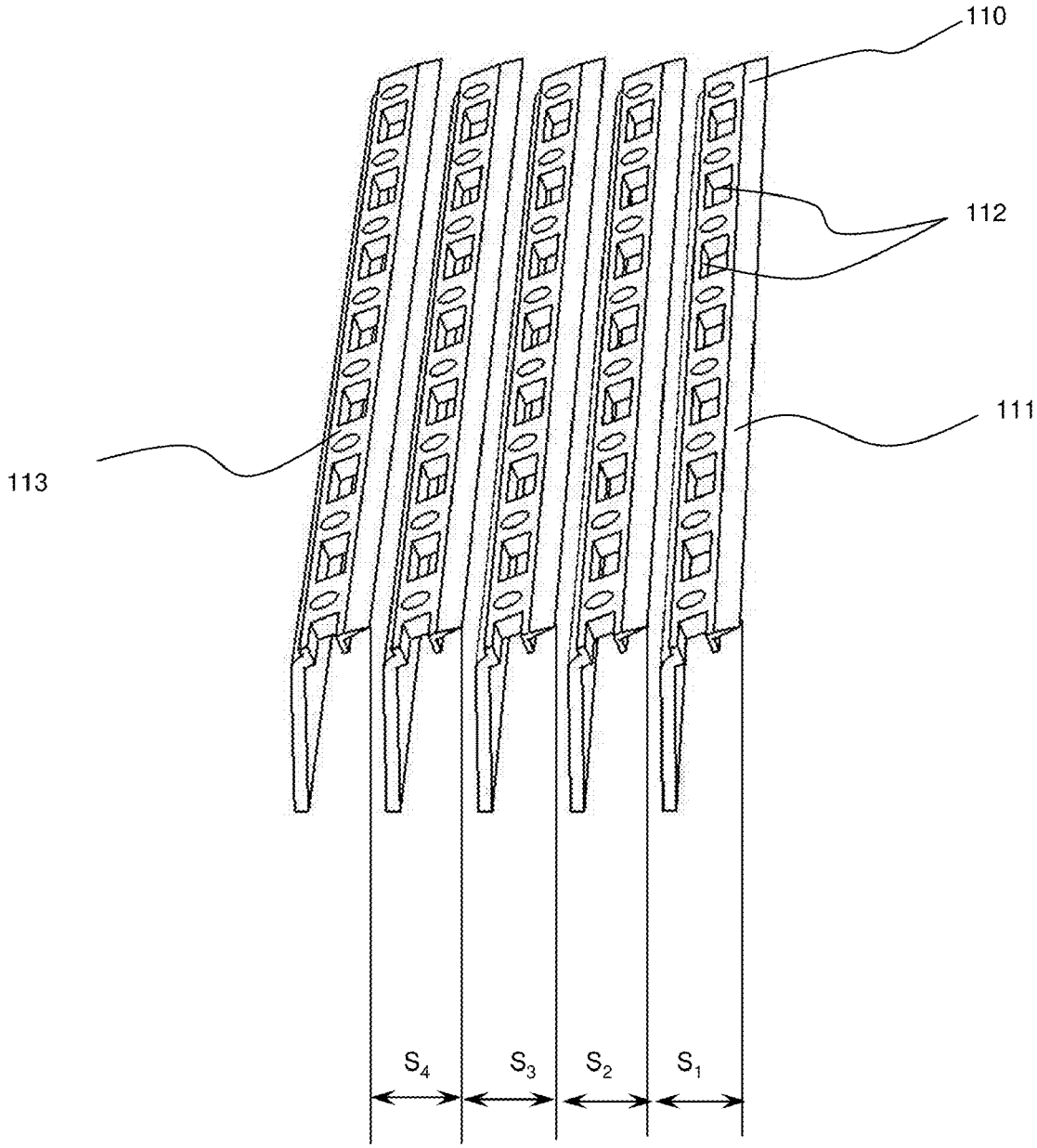
FIG. 2 shows a perspective of an alternate blade configuration of the razor cartridge of FIG. 1.

The blade assemblies 10 optionally comprise one more perforations 12 along a length of the blade assembly. The perforation(s) may be of any reasonable size that allows for the maintenance of the integrity of the blade assembly, i.e., the strength of the blade assembly. The perforations may be disposed substantially rearward of the cutting edge, e.g., near a bend in the blade assembly 10 that leads to the support portion of the blade assembly, or the perforation(s) may be disposed substantially closer to the cutting edge of the blade assembly such that they occur forward of the same bend. The perforations may also be of any suitable shape, e.g., circular, elliptical, rectangular, square, triangular, slits, or combinations thereof. Suitable perforated blade assembly arrangements are disclosed in detail in copending and co-filed U.S. patent application Ser. No. 12/568,747, entitled "Razor Cartridges with Perforated Blade Assemblies". In FIG. 1, blade assemblies 10 have perforations 12 that are rectangular in shape and are placed coincidental with a bend 13 of the blade assembly. The perforations may, however, be of any shape, e.g., circular, triangular, etc. In FIG. 2, alternate blade assemblies suitable for the invention of the present invention are shown. Moreover, these perforations 112 are disposed substantially forward of a bend 113. Applicants have found that such perforations aid in heightening the rinsability of the overall razor cartridge since they provide open areas from which debris is readily freed during shaving and rinsing. These perforations may be formed by stamp cutting, laser cutting, or any other means of forming apertures in blade assembly materials. Moreover, the blade assemblies 10 and 110 comprise a bent portion at the bend such that the assembly is made of a single piece of material as opposed to an upper portion and a lower portion as has been seen in the past.

With respect to the decreased cumulative span, Applicants have come to realize that the comfort that results from narrower interblade spans are only feasible in a multiple blade razor cartridge where the cartridge is capable of being freed of shaving debris, e.g., hair and/or shave preparation. Thus, in certain embodiments of the present invention, the wet shaving razor cartridge comprises a plurality of at least five elongate blade assemblies disposed in parallel between a guard and a cap, both of a housing, each blade assemblies having a sharp cutting edge; wherein said blade assemblies exhibit a cumulative interblade span of no greater than about 3.4 mm, no greater than about 3.2 mm, no greater than about 2.75 mm, no greater than about 2.5 mm, no greater than about 2.4 mm, no greater than about 2.2 mm, no greater than about 2 mm, and even no greater than about 1.8 mm. In certain other embodiments, the wet shaving cartridge comprises a plurality of at least four elongate blade assemblies disposed in parallel between a guard and a cap, both of a housing, each blade assembly having a sharp cutting edge; wherein said blade assemblies exhibit a cumulative interblade span of no greater than about 2.55 mm, no greater than about 2.4 mm, no greater than about 2.2 mm, no greater than about 2.1 mm, no greater than about 1.8 mm, no greater than about 1.7 mm, no greater than about 1.55 mm, no greater than about 1.4 mm, and even no greater than about 1.35 mm.

In the embodiments of the invention detailed herein, it is likely that the interblade spans ($S_{IB}$) are equal to one another. As shown in FIG. 2, where there are five elongate blade assemblies, the first interblade span (i.e., between primary blade assembly closest to the guard and the successive second blade assembly), $S_1$, the second interblade span, $S_2$, the third interblade span, $S_3$, and the fourth interblade span, $S_4$ are each equivalent to one another. In the instances where there are at least four or five blade assemblies, the interblade span, $S_{IB}$, is no greater than about 0.85 mm, 0.8 mm, 0.75 mm, 0.7 mm, 0.65 mm, 0.6 mm, 0.55 mm, 0.5 mm, 0.45 mm. In other instances, the interblade spans may differ across the cumulative span of the razor cartridge. For example, in the five blade assembly embodiment of FIG. 2, $S_1$ may be greater than each of $S_2$, $S_3$, and $S_4$, which may be equivalent to one another but which may also vary from one another.

Another important aspect of the present invention relates to the span between the blade assembly closest to the guard or the span between the last blade assembly and the cap. Given that the focus of the present invention is on the interblade span, Applicants have incidentally found that it might be useful to maintain a span of less than about 1.4 mm between the guard and the nearest of the plurality of blade assemblies, more particularly from about 0.5 mm about 1.4 mm or even 0.5 mm to about 0.9 mm. These same distances apply between the cap and the nearest of the plurality of blade assemblies. From a manufacturing standpoint, this additional span may further increase the rinsability of the cartridge and also allow for platforming of various cartridge types while using the same manufacturing equipment.

Without being limited by theory, Applicants believe that the blade span to some extent at least determines the size of the skin bulge which forms naturally immediately in front of the blade assembly edge as the razor cartridge is moved over the skin during shaving, and the size of the skin bulge has a strong influence on the drag characteristic.

The wet shaving razor cartridges of the present invention may be mounted permanently on a handle with the intention that the entire razor should be discarded when the blade cutting edges have become dulled. Alternatively, the wet shaving cartridges of the present invention may be detachably mounted to a handle so that the cartridge may be replaced on the handle when the blade assemblies have lost the sharpness required for efficient shaving. In typical cartridges, the blade assemblies are usually carried by the housing, which is generally a molded plastic frame, and the blade assemblies may then be supported to move within the frame, either independently of each other or in unison under forces imparted on the blade assemblies by the skin during shaving. In one embodiment of support within the housing, the blade assemblies are mounted fixedly within slots in a blade retaining member. In most instances, there will be one or more rigid blade retaining members disposed along a length of the housing to provide adequate and immovable support for the blade assemblies disposed therein. In another instance, the blade assemblies may be floatably mounted within the housing. Here, the plurality of blade assemblies is supported by one or more spring loaded blade retaining members where such blade assemblies are permitted to respond to the forces encountered during shaving. The housing comprises a guard at a forward portion. The guard contacts a shaver's skin immediately ahead of the plurality of blade assemblies. The cap is disposed after the plurality of blade assemblies within the housing and toward a rear portion. The cap contacts the skin directly behind the plurality of blade assemblies during a shaving stroke. In the case of both the guard and the cap, each may comprise additional elements that are also joined to or integral to the housing.

In each embodiment of the invention, the level of comfort obtained with any given wet shaving razor cartridge is influenced strongly by the shaving geometry, which is the relative positioning of the skin contacting components. Important parameters of the shaving geometry include the blade exposure which is the distance by which the tip of the blade edge projects above, or is retracted below, a plane which is tangential to the skin contacting parts next in front and next behind the blade edge, the blade tangent angle (also known as the blade shaving angle) which is the angle at which the plane of the blade is inclined to a plane which is tangential to the guard and the cap surfaces (the tangent plane), and the blade span which is the distance by which the blade edge is spaced from the skin contacting element immediately in front of the blade edge, as seen in a plane which is tangential to the blade edge and the skin contacting element in front of it. A progressive blade exposure may be used in the present invention as detailed in U.S. Pat. No. 6,212,777.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wet shaving razor cartridge, comprising:

a plurality of at least five elongate blade assemblies disposed in parallel between a guard and a cap of a housing, each blade assembly having a sharp cutting edge and one or more perforations;

wherein said blade assemblies exhibit a cumulative interblade span of no greater than about 3.2 mm and the one or more perforations are configured for rinse-through of water and debris, wherein each blade assembly further comprises a bent portion integrally formed with the sharp cutting edge and disposed rearward of the cutting edge, and wherein the one or more perforations is disposed near the bent portion, closer to the bent portion than the cutting edge.

2. The wet shaving razor cartridge of claim 1 wherein said blade assemblies exhibit a cumulative interblade span of no greater than about 3 mm.

3. The wet shaving razor cartridge of claim 1 wherein said blade assemblies exhibit a cumulative interblade span of no greater than about 2.75 mm.

4. The wet shaving razor cartridge of claim 1 wherein said blade assemblies exhibit a cumulative interblade span of no greater than about 2.5 mm.

5. The wet shaving razor cartridge of claim 1 wherein each interblade span between blade assemblies is about 0.85 mm.

6. The wet shaving razor cartridge of claim 1 wherein each interblade span between blade assemblies is about 0.75 mm.

7. The wet shaving razor cartridge of claims 1 wherein the blade assemblies exhibit a blade shaving angle of greater than about 23°.

8. The wet shaving razor cartridge of claim 1 wherein said blade assemblies are fixedly mounted within said housing.

9. The wet shaving razor cartridge of claim 1 wherein said blade assemblies are floatably mounted within said housing.

10. The wet shaving razor cartridge of claim 1 wherein said plurality of blade assemblies are secured within said housing by one or more clips disposed at one or more opposing ends of said plurality of blade assemblies.

11. The wet shaving razor cartridge of claim 1 wherein the plurality of blade assemblies exhibit an increasing blade exposure as said blade assemblies are arranged from the guard to the cap.

12. The wet shaving razor cartridge of claim 1 wherein a span from the guard to the nearest of the plurality of blade assemblies is less than about 1.4 mm.

13. A wet shaving razor cartridge, comprising:

a plurality of at least four elongate blade assemblies disposed in parallel between a guard and a cap of a housing, each blade assembly having a sharp cutting edge and one or more perforations;

wherein said blade assemblies exhibit a cumulative interblade span of no greater than about 2.55 mm and the one or more perforations are configured for rinse-through of water and debris, wherein each blade assembly further comprises a bent portion integrally formed with the sharp cutting edge and disposed rearward of the cutting edge, and wherein the one or more perforations is disposed near the bent portion, closer to the bent portion than the cutting edge.

14. The wet shaving razor cartridge of claim 13 wherein said blade assemblies exhibit a cumulative interblade span of no greater than about 2.4 mm.

15. The wet shaving razor cartridge of claim 13 wherein each interblade span between blade assemblies is about 0.85 mm.

* * * * *